US006302045B1

(12) United States Patent
Mahr

(10) Patent No.: US 6,302,045 B1
(45) Date of Patent: Oct. 16, 2001

(54) THREE LAYER MOLDED SAIL CONSTRUCTION

(75) Inventor: Peter Mahr, Weston, CT (US)

(73) Assignee: North Marine Group, Milford, CT (US)

( * ) Notice: Subject to any disclaimer, the term of this patent is extended or adjusted under 35 U.S.C. 154(b) by 0 days.

(21) Appl. No.: 09/690,575

(22) Filed: Oct. 17, 2000

(51) Int. Cl.[7] ..... B63H 9/04
(52) U.S. Cl. ..... 114/102.33
(58) Field of Search ..... 114/102.29, 102.31, 114/102.33

(56) References Cited

U.S. PATENT DOCUMENTS

| | | | | |
|---|---|---|---|---|
| 94,400 | * | 8/1869 | Crandall | 114/102.33 |
| 3,680,519 | * | 8/1972 | Jalbert | 114/102.33 |
| 5,172,647 | * | 12/1992 | Towne | 114/103 |

* cited by examiner

*Primary Examiner*—Ed Swinehart
(74) *Attorney, Agent, or Firm*—Pyle & Piontek

(57) ABSTRACT

A triangular sail is made by laminating three triangular layers of reinforced film together on a mold to provide a one piece molded sail. Each layer is made up of a plurality of triangular pieces which radiate out of one of the three corners of the sail, such that the pieces in each layer cross in the body of the sail.

7 Claims, 5 Drawing Sheets

THREE LAYER MOLDED SAIL CONSTRUCTION

BACKGROUND

This invention relates to sails for sailing vessels and more particularly to sails which are formed as one piece laminates on a mold.

U.S. Pat. No. 5,097,784 describes an adjustable mold upon which a one piece, laminated, three-dimensional sail may be formed. After adjusting the mold to the desired shape, a layer of film is applied to the mold surface. An overhead gantry then applies adhesively coated yarns to the base film layer in a three-dimensional fashion. A final layer of adhesively coated film is applied, and the assembly is laminated on the mold using heat and pressure.

The preparation of sails on a static mold is a time consuming process, especially since a moving gantry must be devised and used to apply individual yarns in a predefined fashion. In general, it would be desirable to simplify the procedure described in the above patent while still providing a laminated one piece sail in which the three-dimensional shape is molded into the sail.

SUMMARY OF THE INVENTION

The molded sail of the present invention comprises three corners and is made from three separate superimposed film layers. Each layer, in turn, comprises a plurality of generally triangular film pieces which radiate out of a respective corner and terminate at an opposite edge of the sail. Thus, the three layers are triangular in shape, with the three triangles having an apex at the respective three corners of the sail.

The triangular sections making up each of the layers include parallel yarns or a scrim on one side, which side is coated with adhesive. The first triangular layer is applied to the mold with the yarns and adhesive facing outwardly. The second layer is applied over the first with the adhesive coated side facing in either direction, and the third layer is applied with the adhesive and yarns facing inwardly. Heat and pressure are then applied to the assembly on the mold to obtain a three-dimensional laminate.

In the final laminate, the pieces making up each layer intersect with pieces in successive layers at three angles to provide a seamless, one-piece sail of good integrity and durability. At the same time, the need for using a gantry for separately applying yarns to a sail is avoided.

DETAILED DESCRIPTION

Figure 5:
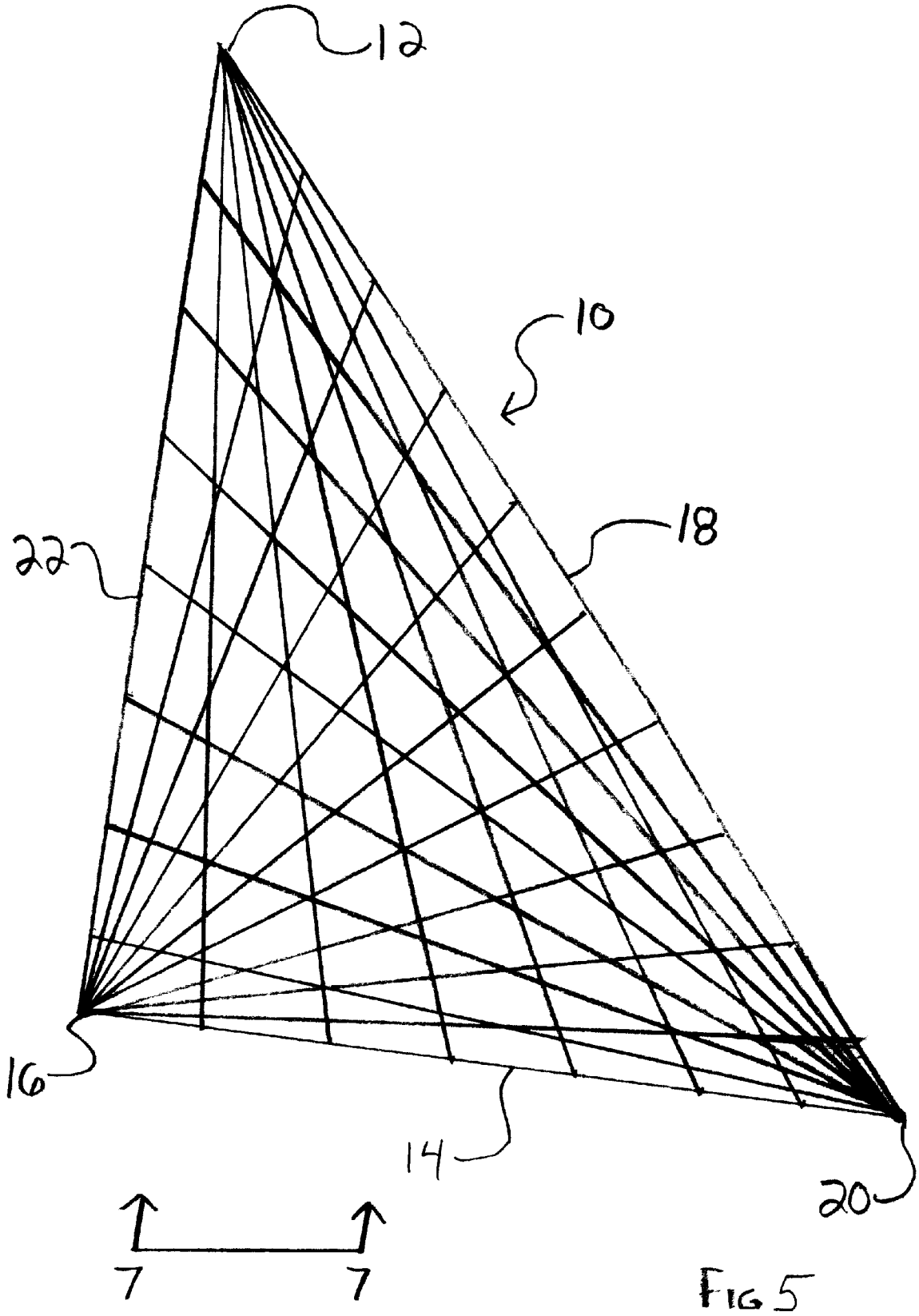
FIG. 5 is a plan view showing the individual crossing portions in the finished three-layer sail.

FIG. 5 illustrates the sail 10 of the present invention as having a head 12 or top corner with an opposed lower foot 14, a clew 16 or lower rear corner with an opposed forward edge or luff 18, and a lower forward corner or tack 20 having an opposed rear edge of the sail or leech 22.

Figure 1:
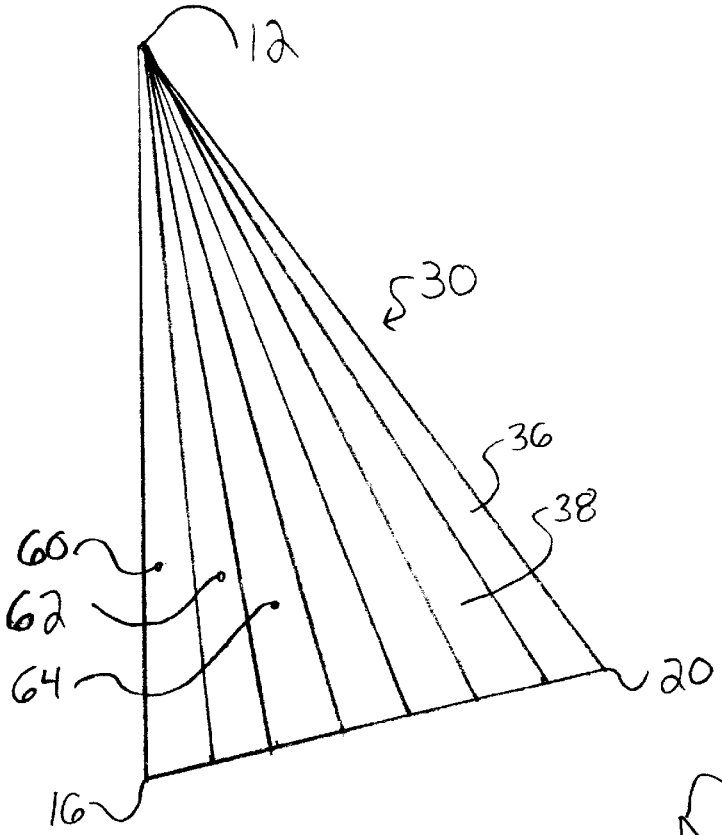
FIGS. 1, 2, and 3 are plan views of the three layers of the molded sail of the present invention.
Figure 2:
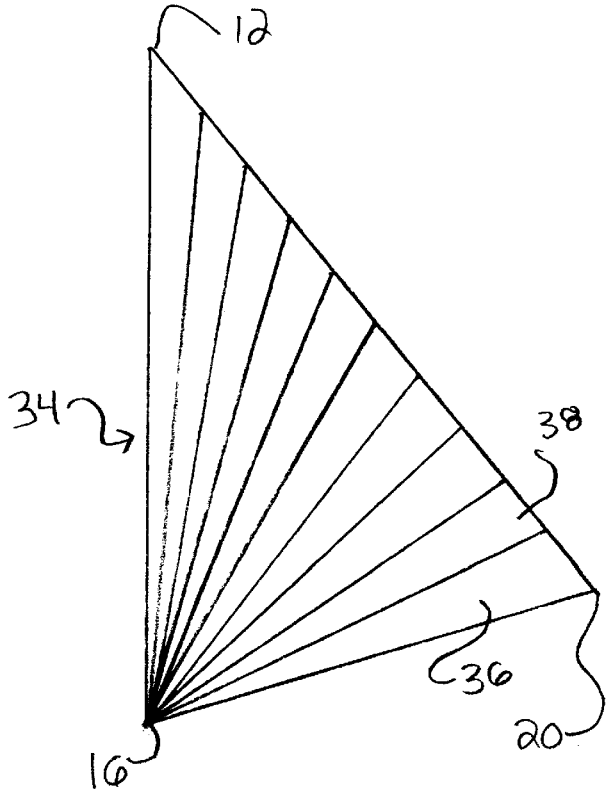
Figure 3:
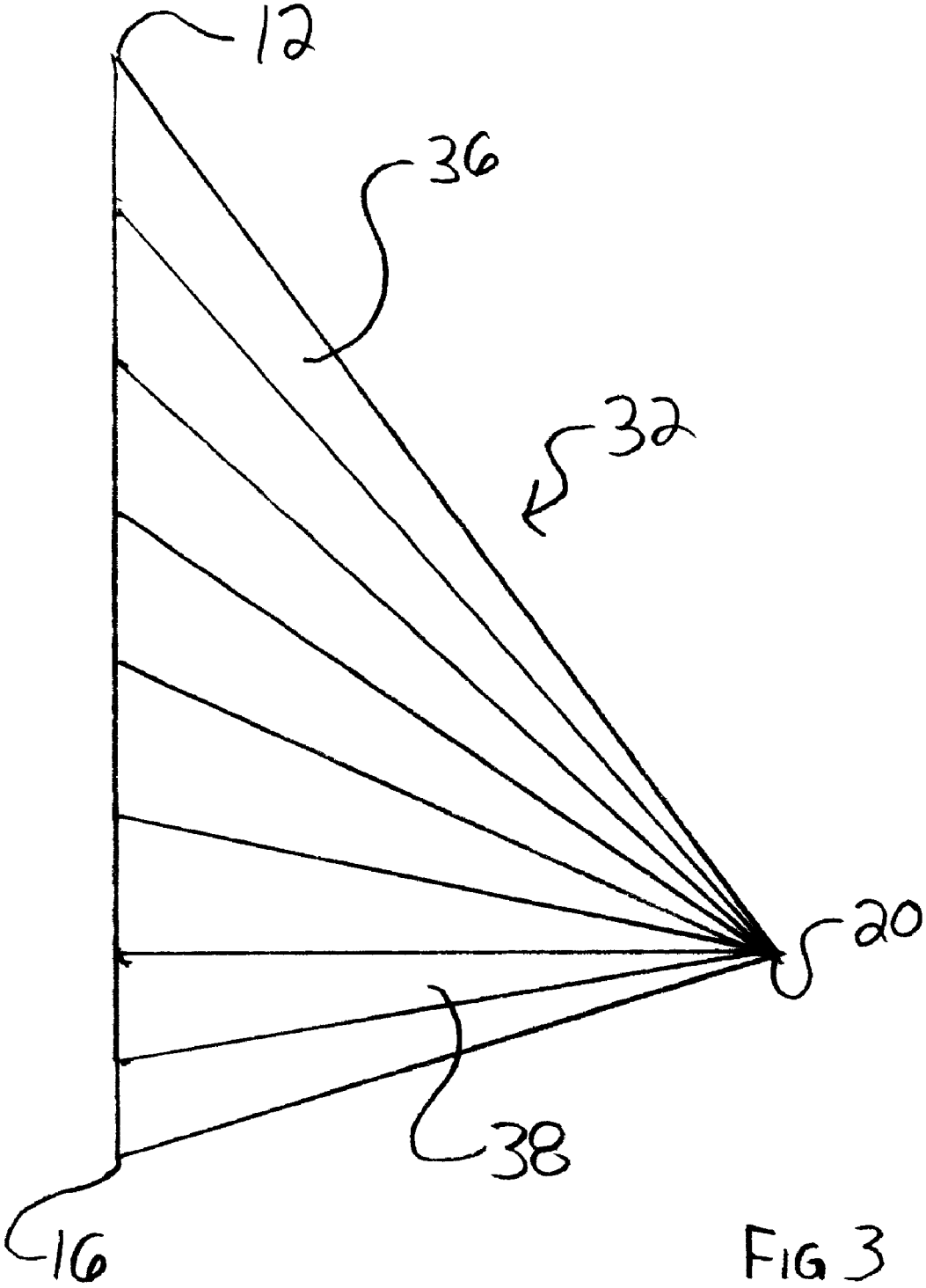

FIGS. 1, 2, and 3 illustrate the three layers 30, 32, and 34 of the sail. Each of the layers generally triangular in shape, with each triangular layer being made up of a number of individual triangular pieces such as 36 and 38. The apex of each triangular piece for each layer originates at a common corner such as the head 12, clew 16 and tack 20.

Figure 4:
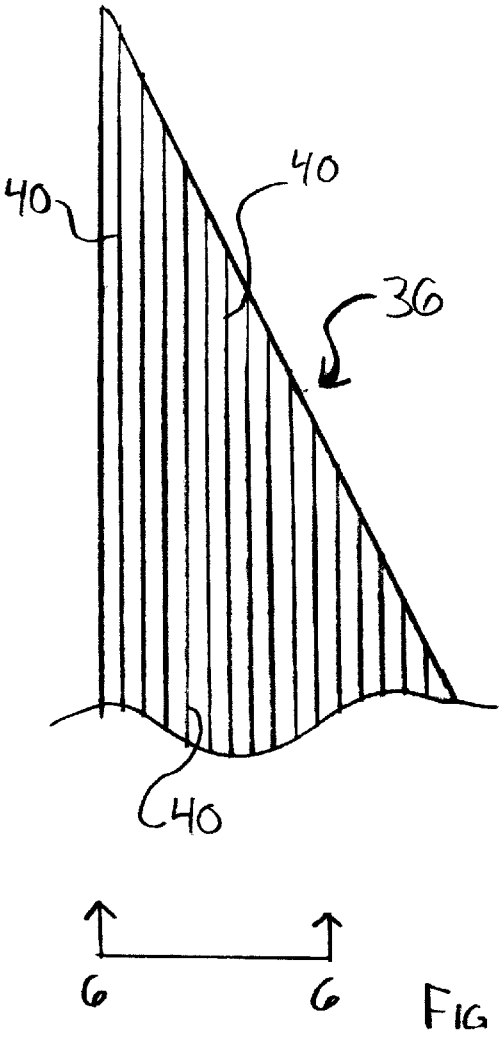
FIG. 4 is a plan view of a yarn layout of one of the individual pieces of each layer shown in FIGS. 1–3.
Figure 6:
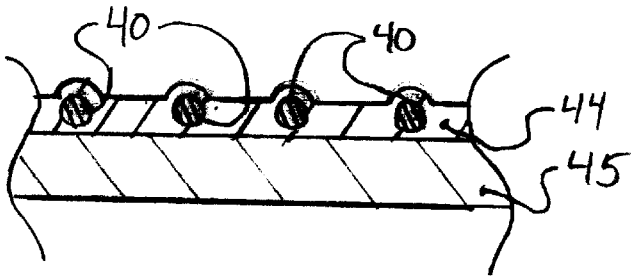
FIG. 6 is a partial sectional view of one of the three layers.

FIGS. 4 and 6 show an individual triangular piece such as 36 used in the assembly of each layer. Although not shown in FIGS. 1–3, each individual piece includes a plurality of primary reinforcing elements 40 secured to one side of the film 45 by adhesive, and an adhesive layer 44 applied to the film. In the preferred embodiment, the reinforcing elements 40 are parallel yarns which preferably run generally parallel to one of the long edges of the triangle from the apex. The angle of each piece forming a corner is an acute angle. Additional cross reinforcing elements or yarns 42 may be applied over or under the primary reinforcing elements to form a scrim. Although the pieces in each layer are shown generally as triangular, the side edges may be shaped somewhat such that the assembled layer better conforms to the mold.

The reinforcing elements can be preapplied by a layer of adhesive 44 to long, flat sections of film, and the film may be furnished in roll form. The triangular pieces may then be cut on a flat surface and joined by adhesive tape prior to application to the mold.

Although any type of film known in the art of sailmaking can be employed, polyester film is preferred, having a thickness of 0.25 to one Mil. The spacing of parallel yarns is in the order of one to 10 per inch, with the yarns having deniers in the order of 1,000 to 10,000. The yarns can be composed of any yarn known in the art of sailmaking, such as polyester, aramid, high modules polyethylene, PEN, carbon and the like.

As shown in FIG. 1, the film sections radiating from the head near the leech, such as 60, 62, and 64, may include heavier or additional yarns in comparison with other pieces, in order to provide additional reinforcement certain areas, for example, along the leech.

The sail is assembled on a mold, such as described in U.S. Pat. No. 5,097,784, incorporated herein by reference. The mold has an outer, smooth continuous convex surface generally in the shape of a wing or foil. The mold is mounted in a support structure, and preferably the shape of the mold is adjustable by use of a number of pneumatic actuators located beneath the mold. This allows for the production of a large number of triangular sails of many shapes and sizes. The information for the shape adjustment may be stored in a computer.

The first layer, such as shown in FIG. 1, may be applied to the mold, with the adhesive and yarn side facing outwardly, with the film surface against the mold surface. The second layer may be applied with he adhesive/yarn side facing in either direction. Finally, the third layer may be applied with the adhesive/yarn facing inwardly.

The adjacent edges of the individual triangular pieces which make up each layer may be overlapped slightly for improved strength. The type of adhesive employed is a hot set adhesive which is actuated substantially above ambient temperatures, for example, in excess of 200° F. Double sided adhesive tape may be used to hold the pieces of each layer together to facilitate assembly of the pieces and transfer of each layer to the mold.

The three triangular layers which make up the three layer laminate are compressed on the mold and heated to activate the adhesive. Pressure may be applied by use of a known vacuum bag technique, in which an outer impervious blanket is applied over the assembly, and a vacuum is applied between the blanket and the surface of the mold. Heat may be applied with the use of a heat gun or heat lamp.

The application of heat and pressure to the assembly, followed by cooling, causes the triangular laminate to permanently deform into a three-dimensional shape, with the laminate being one piece and devoid of seamed panels commonly found in traditional sails. Since the loads on a sail are concentrated at the corners, the construction allows loads to be transmitted away from the corners.

As may be seen in FIGS. 1–3, the overall size of each of the three layers is the same as the size of the final laminate, and each layer contributes to the perimeter of the sail, with an inner film/yarn layer between two outer layers, with no yarns being exposed. If desired, additional internal layers could be added, such as a woven or nonwoven fabric, a layer of random fibers, a scrim layer, and the like.

Figure 7:
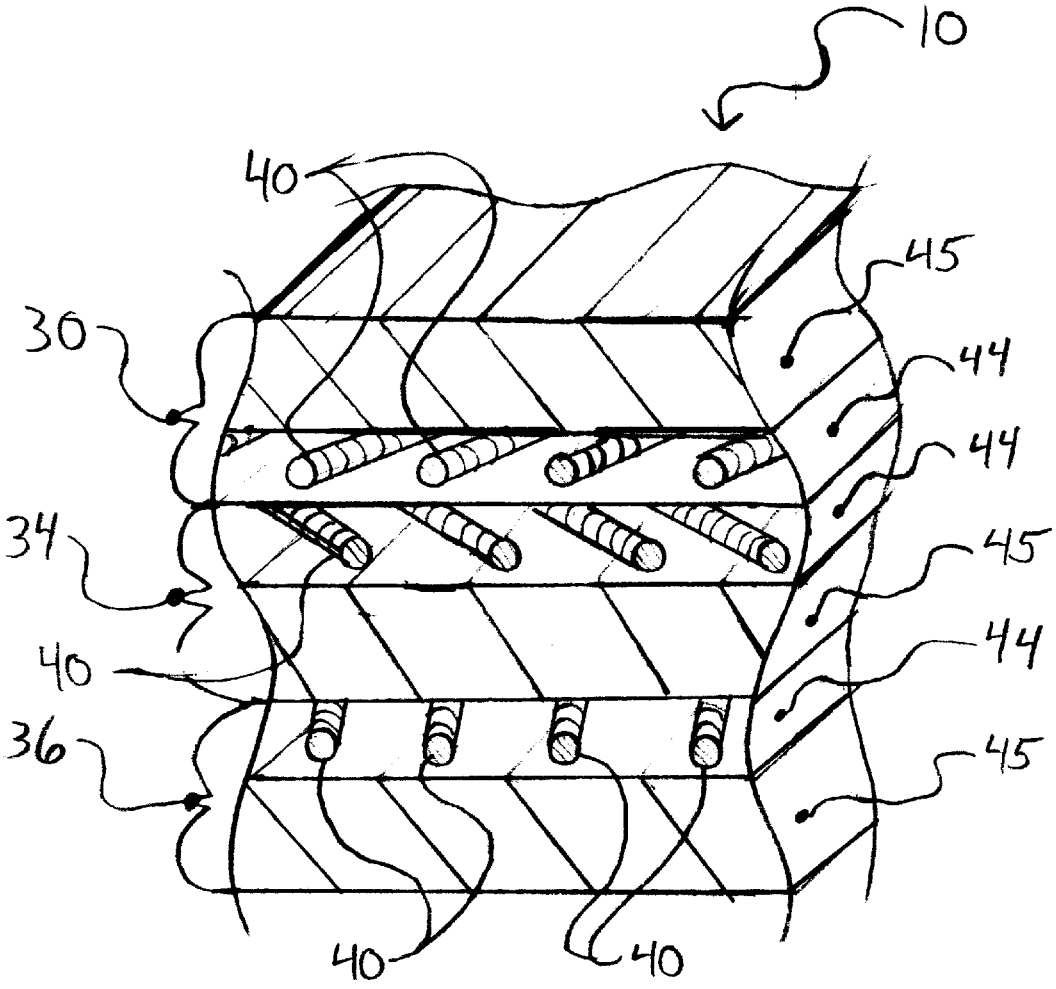
FIG. 7 is a sectional view of the three-layer laminate.

As illustrated in FIGS. 5 and 7, upon lamination of the assembly, it will be noted that the pieces of each layer and the yarns carried thereby, intersect all of the pieces of the other layers, to better hold the laminate together, and the sail is a one piece molded construction, devoid of panels as that terms is used in the art of sailmaking. In the distribution of loads at the three corners, the three layers act independently of each other.

What is claimed is:

1. A sail, said sail comprising a triangular body having three corners and three edges opposed to the three corners, said body comprising three triangular layers of film, each of said layers comprising plurality of triangular pieces of film radiating out from a different one of the three respective corners and terminating at an opposed edge, said triangular layers being laminated together on a mold in the form of a one piece molded sail.

2. The sail of claim 1 wherein individual yarns are laminated to one side of pieces of film which comprise the three layers.

3. The sail of claim 2 wherein the three triangular layers comprise two outer layers and an inner layer, and the yarns on the inner layer face inwardly, thereby providing a film layer facing outwardly.

4. The sail of claim 2 wherein the said triangular pieces have an apex with an acute angle, and the yarns run generally in parallel to a long edge of said piece toward the edge opposite to a corner.

5. The said sail of claim 2 wherein pieces of a layer comprises yarns of more than one denier.

6. The sail of claim 1 wherein the triangular layers are substantially the same size as the sail.

7. The sail of claim 1 wherein adjacent pieces of a layer are overlapped for improved strength in the final laminate.

* * * * *